US008011113B2

(12) United States Patent
Delaine

(10) Patent No.: US 8,011,113 B2
(45) Date of Patent: Sep. 6, 2011

(54) HOT GAS GENERATOR AND DRYING OR DEHYDRATION FACILITY IMPLEMENTING SUCH A GENERATOR

(75) Inventor: Patrick Delaine, Saint Doulchard (FR)

(73) Assignee: Nexter Munitions, Versailles (FR)

( * ) Notice: Subject to any disclaimer, the term of this patent is extended or adjusted under 35 U.S.C. 154(b) by 273 days.

(21) Appl. No.: 12/308,253

(22) PCT Filed: Jun. 18, 2007

(86) PCT No.: PCT/FR2007/001004

§ 371 (c)(1),
(2), (4) Date: Dec. 11, 2008

(87) PCT Pub. No.: WO2007/147961

PCT Pub. Date: Dec. 27, 2007

(65) Prior Publication Data

US 2010/0162587 A1 Jul. 1, 2010

(30) Foreign Application Priority Data

Jun. 22, 2006 (FR) ..... 06 05589

(51) Int. Cl.
*F26B 19/00* (2006.01)

(52) U.S. Cl. ..... 34/219; 34/73; 34/86

(58) Field of Classification Search ..... 34/219, 34/73, 86; 126/110 R, 112, 116 R; 431/215; 165/163

See application file for complete search history.

(56) References Cited

U.S. PATENT DOCUMENTS

| | | | |
|---|---|---|---|
| 2,119,817 | A | 6/1938 | Keller |
| 3,053,512 | A | 9/1962 | Soudan et al. |
| 5,966,838 | A | 10/1999 | Krebs et al. |
| 6,725,566 | B1 | 4/2004 | Skrotsky et al. |

FOREIGN PATENT DOCUMENTS

| | | | |
|---|---|---|---|
| DE | 24 37 016 | A1 | 2/1976 |
| DE | 100 11 177 | A1 | 9/2001 |
| DE | 100 27 278 | A1 | 12/2001 |
| EP | 0 049 677 | A2 | 4/1982 |
| EP | 0 508 546 | A1 | 10/1992 |
| EP | 0 832 856 | A2 | 4/1998 |
| EP | 0 854 337 | A1 | 7/1998 |
| EP | 1 260 780 | A1 | 11/2002 |
| FR | 767.424 | | 7/1934 |
| GB | 423991 | | 2/1935 |
| GB | 755175 | | 8/1956 |
| GB | 780925 | | 8/1957 |
| GB | 962561 | | 7/1964 |
| NL | 46284 | | 7/1939 |
| WO | WO 02/12812 | A1 | 2/2002 |

*Primary Examiner* — Jiping Lu

(74) *Attorney, Agent, or Firm* — Oliff & Berridge, PLC

(57) ABSTRACT

The subject of the invention is a hot gas generator (8), particularly for a dehydration or drying unit, the generator comprising a burner or hearth (9) and being characterized in that it comprises at least one exchange circuit (10) comprising at least one pipe through which the gas to be heated flows, the pipe comprising a cool gas inlet end (11) and a hot gas discharge outlet (12), the pipe having a surface for heat exchange between the combustion gases generated by the burner or hearth (9) and the gas to be heated which flows through the pipe, the pipe also providing a physical barrier between the heated gases and the combustion gases generated by the burner or hearth. Application to producing a drying or dehydration installation.

19 Claims, 8 Drawing Sheets

HOT GAS GENERATOR AND DRYING OR DEHYDRATION FACILITY IMPLEMENTING SUCH A GENERATOR

BACKGROUND OF THE INVENTION

1. Field of Invention

The technical scope of the invention is that of hot gas generators, namely generators intended to equip dehydration or drying units for materials.

2. Description of Related Art

It is known (for example by EP0049677) to produce a drying unit for ligneous waste incorporating drying means supplied by the combustive gases produced by a boiler.

This device makes direct use of the combustive gases. However, the latter incorporate residues, which impregnate, to a greater or lesser extent, the dry material and limit the subsequent use of such material.

It is thus impossible to implement such a drying unit to dehydrate edible materials that are intended to be consumed afterwards (for example by animals).

Even for the drying and dehydration of ligneous waste, the combustion residues impregnate the wood thereby altering its external aspect. The combustion residues are then likely to seep out of the wood leading to pollution in dwelling places. The combustion residues are also likely to hinder any future transformation of the wood (for example its use in furniture) by modifying its mechanical properties.

SUMMARY OF THE INVENTION

The aim of the invention is to propose a hot gas generator that overcomes these drawbacks.

The generator according to the invention is thus able to generate a current of hot gas whose chemical properties can be fully controlled.

Furthermore, the generator according to the invention also enables the temperature of the gases generated to be controlled whilst enabling the thermal energy of the burner or heating appliance to be recovered with excellent efficiency.

The generator according to the invention may implement burners or heating appliances based on different technologies and using all types of fuel. In all cases, it ensures the generation of a hot and clean gas which does not disturb the drying or dehydration process.

Thus, the invention relates to a hot gas generator, namely for a dehydration or drying unit, such generator incorporating a burner or a heating appliance and wherein it incorporates at least one exchange circuit incorporating at least one manifold in which the gas circulates that is to be heated, such manifold incorporating one intake end for cool gas and one exhaust outlet end for the hot gas, such manifold having a thermal exchange surface for the combustive gases generated by the burner or heating appliance and the gas to be heated circulating in the manifold, the manifold furthermore proving a physical separation between the heated gases and the combustive gases generated by the burner or heating appliance.

The manifold or manifolds of the exchange circuits will preferably be oriented such that the heated gas flow circulates in the manifold in a direction that is the opposite of that of the combustive gas flow from the burner or heating appliance.

The hot gas generator may incorporate means enabling the flow rate of the gases exiting the different manifolds to be regulated.

Each exchange circuit may furthermore incorporate an outlet collector channel and at least one inlet channel, the outlet channel and the inlet channel are connected to one another by manifolds which are substantially parallel to one another.

The inlet channels and the outlet channel may be substantially ring-shaped.

The hot gas generator may incorporate at least one set of manifolds having an undulated profile.

It may thus comprise an O-shaped duct to collect the hot gases, such duct being linked to the outlet collector by tubes.

It may furthermore comprise an inlet duct for cool gas which will be connected to the different inlet channels by tubes.

According to a particular embodiment, the means enabling the flow rate of the hot gases to be regulated will be constituted by valves positioned between the cool gas inlet duct and each tube linking this duct to the different inlet channels.

The inlet channels will advantageously be compartmented into different sectors, each sector being linked to a single valve.

The hot gas generator may incorporate at least two exchange circuits, each exchange circuit being positioned in a chamber through which the combustive gases circulate.

The two chambers may be concentric, the passage of combustive gases from one chamber to another being made at one end of a first chamber, the direction of circulation of the combustive gases in the second chamber being the opposite that that in the first chamber.

The cool gas inlet duct may be positioned coaxially to the first chamber inside a vent to evacuate the combustive gases.

The burner or heating appliance may, in addition, be positioned at a second end of the first chamber.

The hot gas generator may incorporate a third chamber surrounding the second chamber, such third chamber enclosing the manifolds linking the exchange circuit of the second chamber to the cool gas inlet duct.

The invention also relates to a dehydration or drying facility implementing such a hot gas generator.

This dehydration or drying facility may be such that the cool gas inlet duct of the hot gas generator is linked to a circuit to recover the hot air which will be extracted from an enclosure receiving the matter or materials to be dehydrated.

The hot air recovery circuit may incorporate at least one condenser ensuring the dehydration of the air.

The dehydration or drying facility may comprise a circuit to activate the burner or heating appliance which uses part of the hot air from the condenser.

It may additionally comprise a mixer positioned upstream of the enclosure and enabling the hot air from the generator to be mixed with part of the cool air from the condenser.

BRIEF DESCRIPTION OF THE DRAWINGS

The invention will become more apparent form the following description of the different embodiments, such description being made with reference to the appended drawings, in which.

DETAILED DESCRIPTION OF PREFERRED EMBODIMENTS

Figure 1:
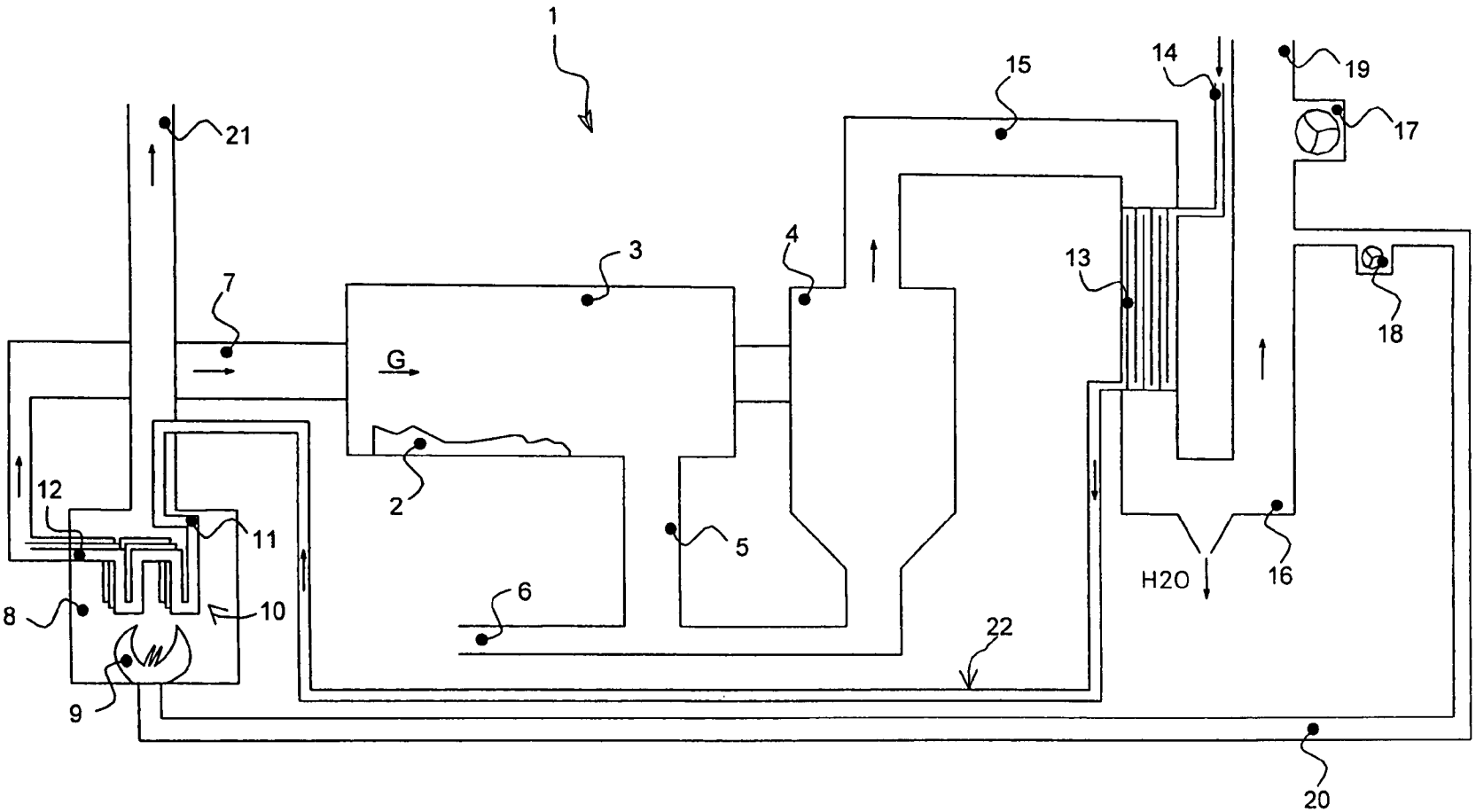
FIG. 1 schematically shows a drying facility for organic material that implements a hot gas generator according to the invention.

FIG. 1 shows a facility 1 enabling organic matter 2 to be dried.

This matter 2 (for example, agricultural waste or bread making waste) is placed in a furnace 3. The matter may be carried on transport means (not shown) such as a conveyor belt or endless screw.

This transport means will enable the furnace 3 to be loaded and unloaded.

The furnace 3 is connected to a cyclone 4 whose purpose is to separate the solid matter from the gaseous current circulating in the furnace 3.

The dried or dehydrated sold matter is evacuated either periodically or continuously (depending on the process) by ducts 5 and 6.

Drying is ensured thanks to a hot gaseous current G circulating in the furnace 3 conducted by a channel 7 that comes out of a hot gas generator 8.

The generator 8 is shown schematically here in the form of an exchanger. It incorporates a burner or heating appliance 9 (for example a gas burner or biomass appliance) and an exchange circuit 10 incorporating at least one manifold in which the gas to be heated circulates. Here, the hot gas is air.

The manifold of the exchange circuit 10 incorporates a fresh air intake end 11 and a hot air evacuation end 12.

The intake end 11 is linked to a condenser 13 which by means of duct 15 receives the hot air 15 exiting the upper part of the cyclone 4. This condenser is cooled by fresh air circulating in an exchange circuit and entering in this circuit by the inlet manifold 14.

The condenser 13 ensures the dehydration of the hot air circulating in the duct 15 and the pre-heating of the ambient air previously dehydrated and conducted by the manifold 14.

The air thus heated is conducted to the inlet end 11 of the exchange circuit 10 by a duct 22.

Liquid water ($H_2O$) is recovered at the bottom 16 of the condenser 13. An accelerator (such as a pump or extractor) 17 is arranged at a vent 19 which evacuates the gases and enables the flow of hot air G circulating in the furnace 3 to be accelerated and regulated.

Furthermore, part of the residual hot air is also used to activate the burner or heating appliance 9. This hot air is conducted to the burner by duct 20 on which an accelerator 18 has been installed.

The combustive gases from the burner or heating appliance 9 are evacuated by a duct 21.

In accordance with the invention, the manifold of the exchange circuit 10 has a surface that enables good heat exchange between the combustive gases generated by the burner or the heating appliance 9 and the gas to be heated (here, air) brought by duct 22.

The manifold of the exchange circuit 10 further ensures a physical separation between the heated gases and the combustive gases generated by the burner 9.

Thus, the flow of hot gases G is perfectly clean and does not deteriorate the organic matter 2.

FIGS. 2 to 5 show one embodiment of a hot gas generator according to the invention.

Figure 2:
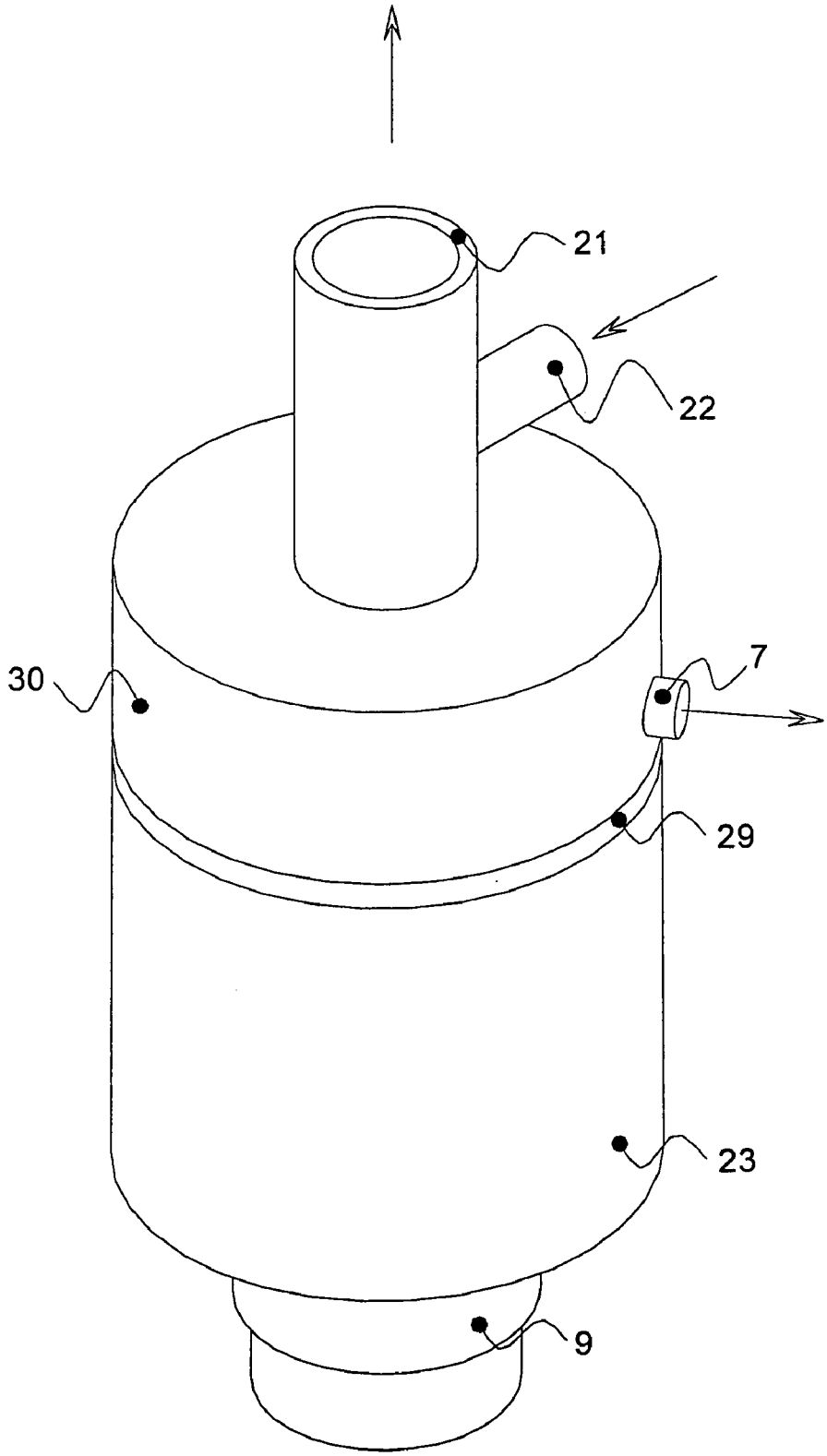
FIG. 2 is an external perspective view of the generator according to one embodiment of the invention.

FIG. 2 shows an external view of this generator 8. We see that it incorporates a substantially cylindrical tank 23. This tank will be positioned vertically (as shown in the Figure) in the case of a biomass appliance and horizontally in the case of a liquid or gas fuelled burner. The lower part of the tank carries the burner or heating appliance 9, the upper part carried the vent 21 to evacuate the combustive gases from the burner or heating appliance 9.

This Figure also shows the fresh air inlet duct 22. This duct passes radially through the vent 21 and (as is more particularly visible in FIGS. 3 to 5) it incorporates one end that is arranged coaxially to the tank 23 and to the interior of the combustive gas evacuation vent 21.

Lastly, FIG. 2 shows the piping 7 which evacuates the hot gases from the generator 8.

Figure 3:
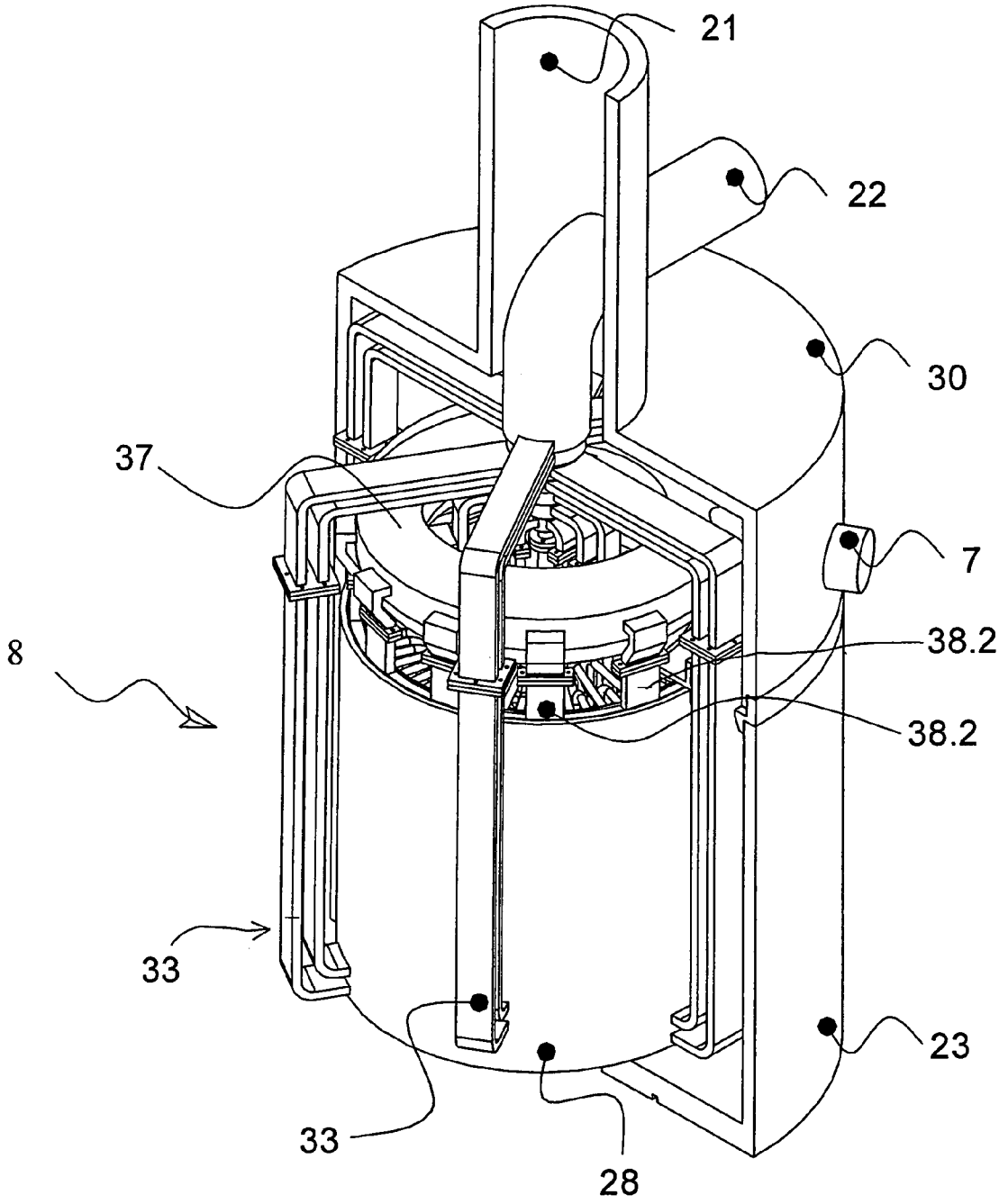
FIG. 3 is another external perspective view of the generator, the shell of the tank being partially sectioned.
Figure 4:
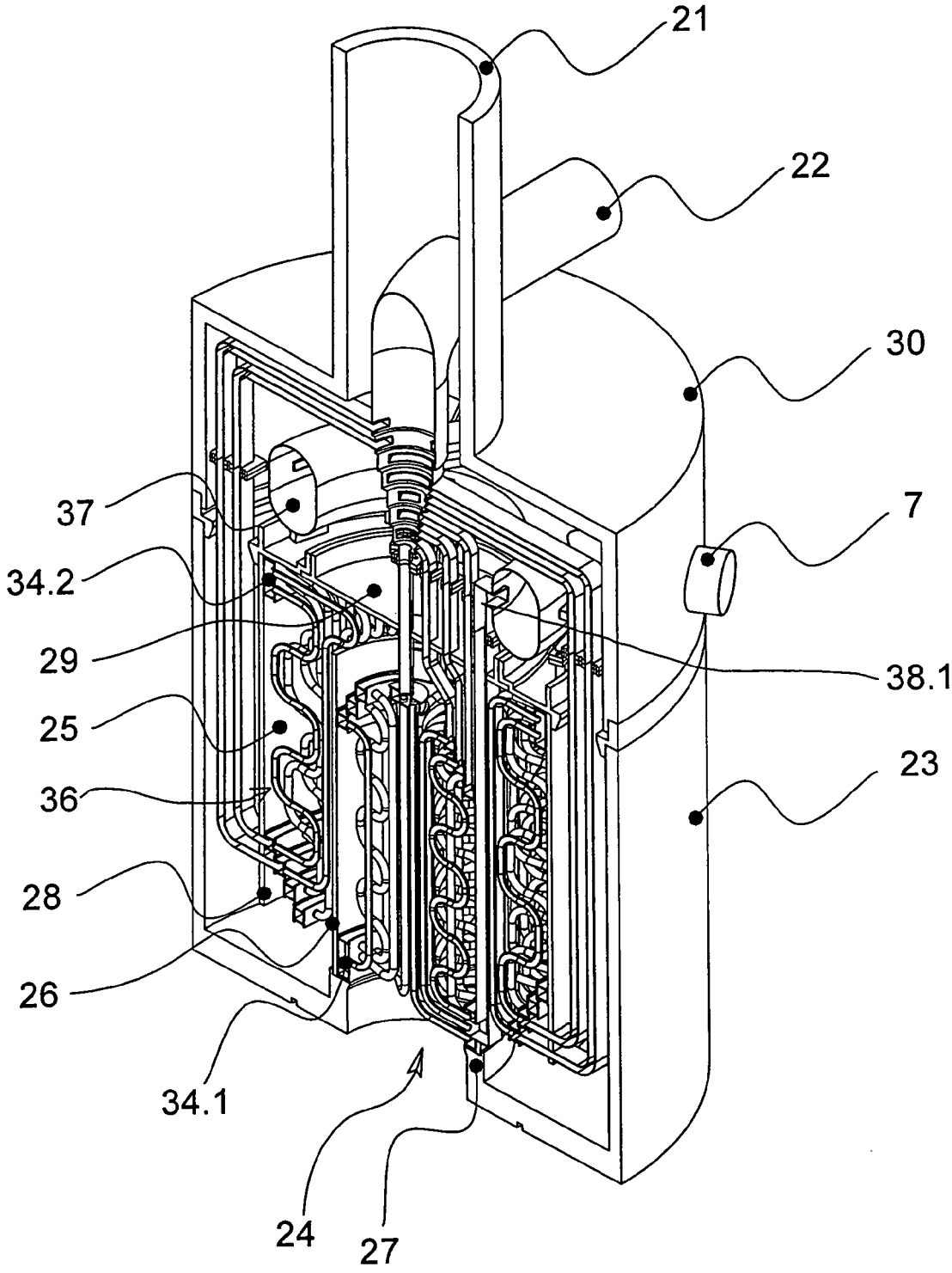
FIG. 4 is another external perspective view of the generator sectioned along a longitudinal plane.
Figure 5:
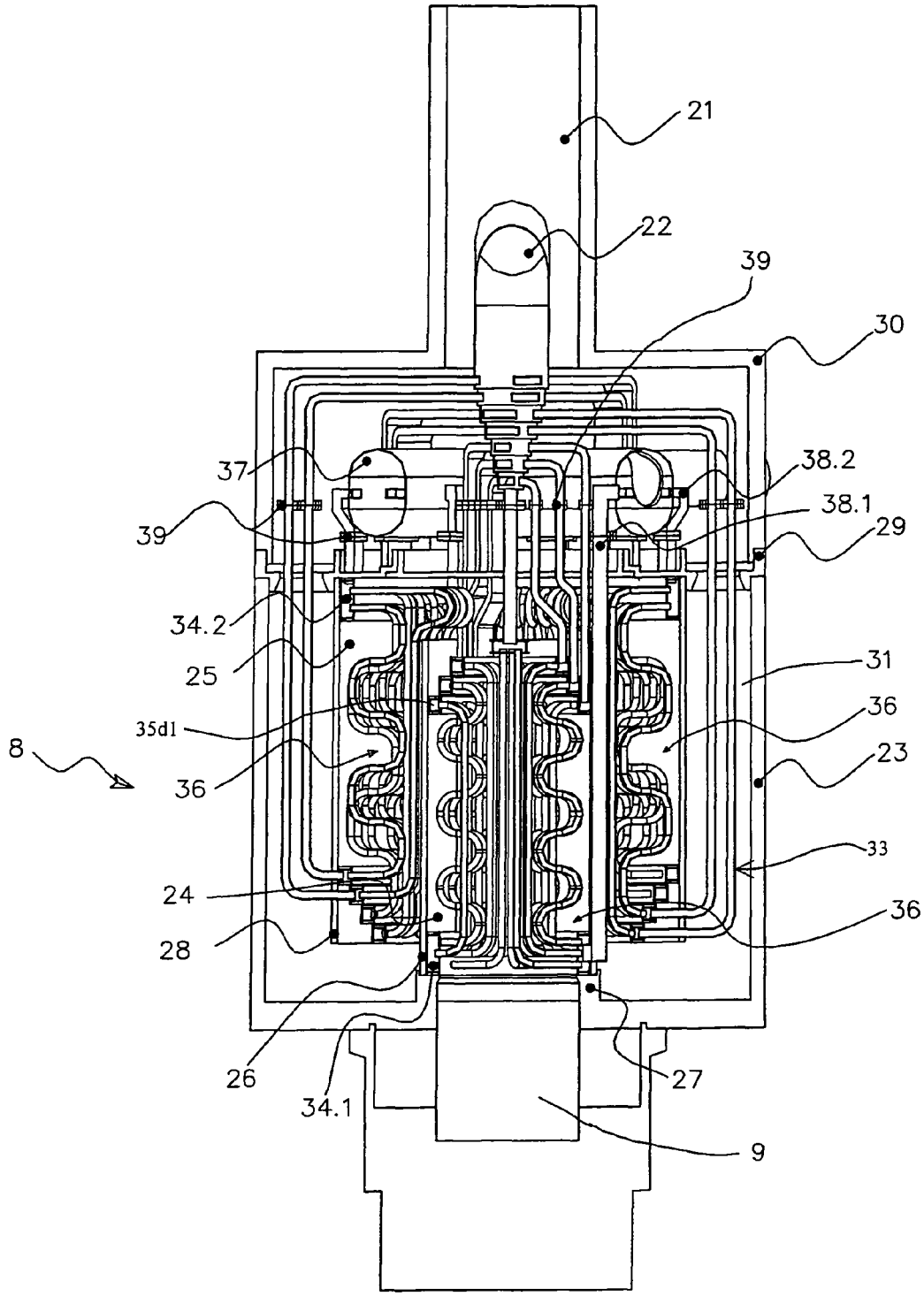
FIG. 5 is a longitudinal section view of the generator assembly.

The internal structure of the generator 8 is more particularly visible in FIGS. 3 to 5.

The tank 23 of the generator surrounds a certain number of manifolds that are organised into different exchange circuits.

Each exchange circuit is positioned in a specific chamber through which the combustive gases from the burner circulate.

The generator thus incorporates a first cylindrical chamber 24 surrounding the axis of the generator and which is delimited by a first cylindrical partition 26 carried by a support 27 integral with the bottom of the tank 23 (FIG. 5).

The generator 8 also incorporates a second ring-shaped chamber 25 surrounding the first chamber 24 and delimited firstly by the first partition 26 and secondly by a second partition 28, concentric to the first partition 26.

The second partition 28 is integral with a plate 29 which is fixed at an upper end of the tank 23 and onto which a box 30 carrying the vent 21 is fastened.

Figure 6:
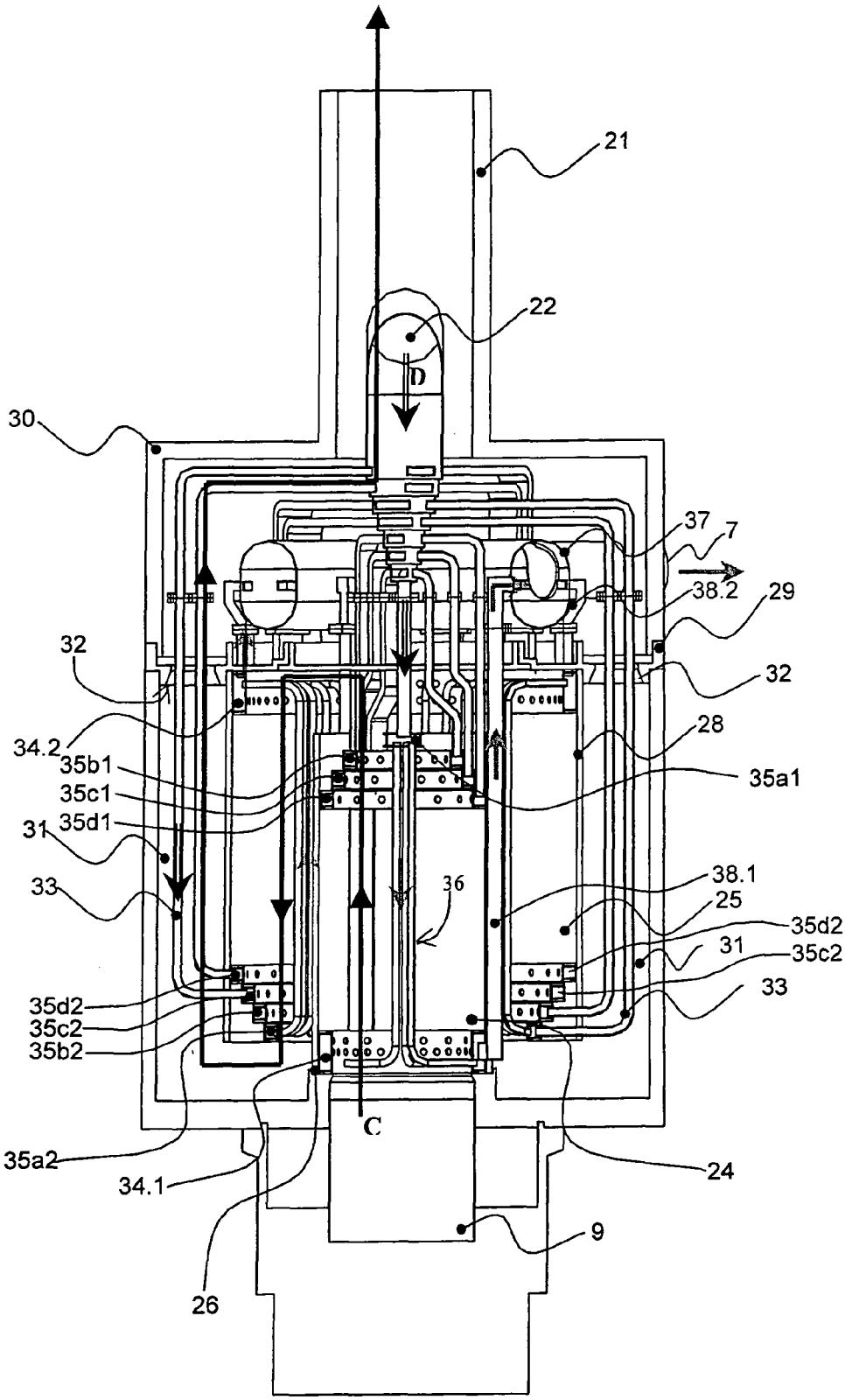
FIG. 6 is an analogous view to that of FIG. 5, but in which certain of the tubes have been removed so as to more precisely show the main circuits and the direction of fluid flow.

As may be seen more particularly in FIG. 6, the combustive gases C from the burner or heating appliance 9 firstly pass through the first chamber 24 in the direction indicated by the arrows C (vertically from bottom to top, either from the burner of heating appliance 9 towards the vent 21).

The gases are stopped by the upper separation plate 29 and they circulate thereafter in the second chamber 25 in the opposite direction, vertically from top to bottom.

Lastly, the combustive gases are stopped by the bottom of the tank 23 and rise through a third chamber 31 delimited by the tank 23 and the second partition 28 to enter the vent 21 via holes 32 made in the plate 29 (FIG. 6).

Thus the combustive gases in the second chamber 25 circulate in the opposite direction to that in which they circulate in the first chamber 24.

The combustive gases in the third chamber 31 furthermore circulate in the opposite direction to that in which they circulate in the second chamber 25.

We also note on the Figures that the cool gas is brought to the generator by a duct 22 which is arranged coaxially to the different chambers 24, 25, 31 and to the interior of the evacuation vent 21 for the combustive gases.

The cool gas is thus introduced in the generator 8 in a direction D which is opposite that of the flow C of combustive gases from the burner or furnace.

This opposite direction is respected in the first chamber 24.

It is also respected in the second chamber 25 (as well as in the third chamber 31).

In fact, the cool gases are brought from the duct 22 into the exchanger which is arranged in the second chamber 25 via the manifolds 33 which conduct the cool gases to the bottom of the second chamber 25.

These cool gases thus rise up in the second chamber in the opposite direction to that of the combustive gases in this second chamber.

This particular orientation of the direction of flow of the gases to be heated in an opposite direction to that of the combustive gases enables the efficiency of the thermal exchange at each exchange circuit to be improved.

In accordance with the invention, each exchange circuit arranged in a chamber is designed so as to optimise the heat transfer.

Each exchange circuit thus incorporates a collector channel with a single outlet for the hot gases and several inlet channels. The outlet collector and the inlet channels are linked to one another by manifolds, which are substantially parallel to one another.

As may be seen in FIGS. 5 and 6, the first exchange circuit (located in the first chamber 24) thus incorporates a ring-shaped outlet collector 34.1 which is arranged near to the burner or heating appliance 9.

The first exchange circuit also incorporates four inlet channels 35*a*1, 35*b*1, 35*c*1 and 35*d*1 (FIG. 6). These channels are all ring-shaped except for channel 35*a*1 which is in fact a box arranged substantially at the axis of the generator.

The diameters of channels 35*b*1, 35*c*1 and 35*d*1 are furthermore different from one another.

The outlet collector 34.1 and the inlet channels 35*a*1, 35*b*1, 35*c*1 and 35*d*1 are linked to one another by manifolds 36 which are substantially parallel to one another.

For purposes of clarity, only the median manifolds 36 linking channel 35*a*1 and the collector 34.1 can be seen in FIG. 6. The other manifolds linking channels 35*b*1, 35*c*1, 35*d*1 to the collector 34.1 are visible in FIGS. 4 and 5.

The division of the exchange circuit from several inlet channels enables the installation of the manifolds 26 to be optimised in the volume of the chamber in question.

The heat exchange surface between the combustive gases and the manifolds of gas to be heated is thus greatly increased. The performance of the generator is thus improved and also its capacity to generate a substantial volume of hot gas.

As may be more clearly seen in FIGS. 4 and 5, certain manifolds 36 are straight and others have an undulated profile.

This undulated profile also enables the heat exchange surface to be increased.

The hot gas generator according to the invention also comprises an O-shaped duct 37 to collect the hot gases supplied by the different exchange circuits.

Duct 37 carries the evacuation piping 7 for the hot gases generated by the generator.

Duct 37 is linked by manifolds (38.1, 38.2) to outlet collectors (34.1, 34.2) for the different exchange circuits.

Thus, the collector 34.1 of the first exchange circuit is linked to duct 37 by rectangular-sectioned manifolds 38.1. See in particular FIGS. 4 and 5.

The second exchange circuit (that which is positioned in the second chamber 25) has an analogous structure to that in the first exchange circuit.

It incorporates a ring-shaped outlet collector 34.2 which is arranged near to the plate 29.

The second exchange circuit incorporates four inlet channels 35*a*2, 35*b*2, 35*c*2 and 35*d*2. These channels are all ring-shaped and positioned at the lower end of the second chamber 25.

As has been explained above, the cool gas is brought from duct 22 to the different inlet channels 35*a*2, 35*b*2, 35*c*2 and 35*d*2 by rectangular-sectioned manifolds 33 (see FIG. 3).

Straight-sectioned or undulated manifolds 36 link the inlet channels and the outlet collector 34.2.

The latter is in turn linked to hot gas evacuation duct 37 by rectangular-sectioned manifolds 38.2. See in particular FIGS. 3, 5 and 6.

The combination of two heat exchange circuits improves the generator's performance. Indeed, the calories supplied by the combustive gases may be recovered by each of the exchange circuits.

Furthermore, the passage of the manifolds 33 in the third chamber 31 enables the preheating of the cool gas upstream of the second chamber and once again uses part of the available calories.

The generator according to the invention thus ensures, for a relatively compact volume, excellent thermal efficiency.

In practical terms, it is possible for a generator 8 to be produced with two exchange circuits that generates a flow at a rate of between 5.0 m/s and 8.0 m/s of hot gases at a temperature of around 600° C.

Someone skilled in the art will easily dimension the generator according to the required characteristics (temperature and output).

The different shapes and lengths of the manifolds 36 (inside a same exchange circuit and between the different exchange circuits) lead to a different energy loss for each manifold.

So as to ensure a homogenous hot gas generation output, means enabling the rate of hot gases exiting the different manifolds may be provided.

These means are, for example, constituted by valves which will be positioned between cool gas inlet duct 22 and each tube linking this duct to the different inlet channels 35 (35*a*1, . . . , 35*d*1, . . . 35*a*2, . . . , 35*d*2).

These means are not shown in detail in FIGS. 3 to 6. They are arranged at the different flanges referenced 39 (FIGS. 5 and 6).

Furthermore, so as to enable the gas rate to be controlled for each group of manifolds, the inlet channels 35 will be compartmented into different sectors, each sector being linked to a single valve. There will therefore not be any disturbance to the gas flow exiting each valve. Gas flowback from an inlet channel to a valve is thus avoided and the output is made more regular.

Compartmenting the channels 35 will be performed simply by providing metal partitions to divide the ring-shaped channel in question into different sectors.

Figure 7A:
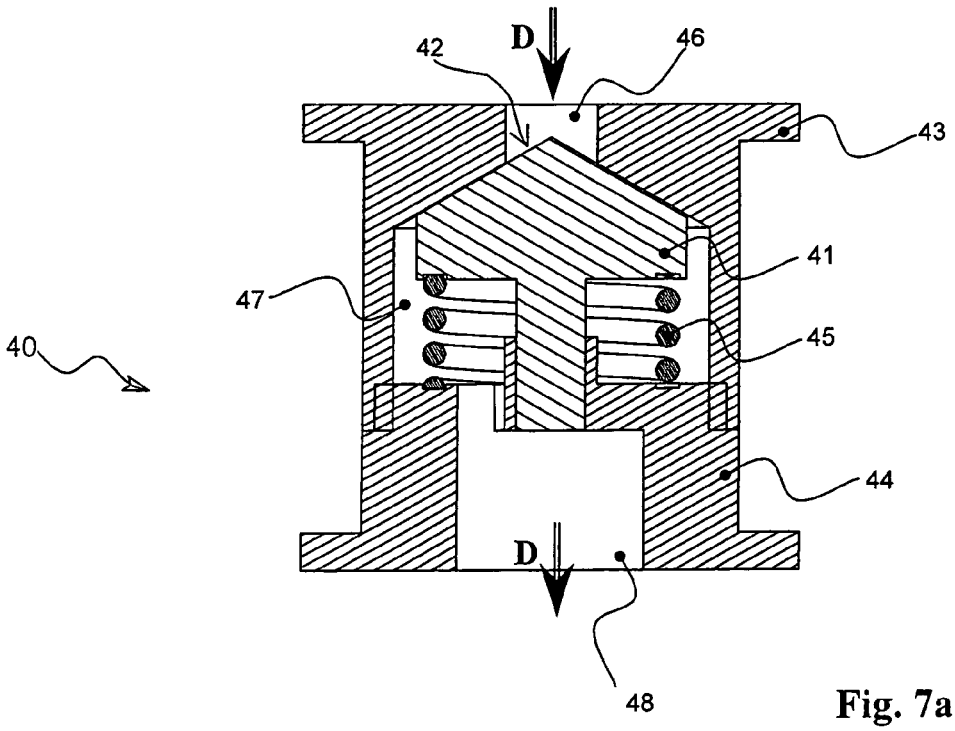
FIG. 7*a* is an enlarged section view of one of the valves implemented in the generator according to the invention.
Figure 7B:
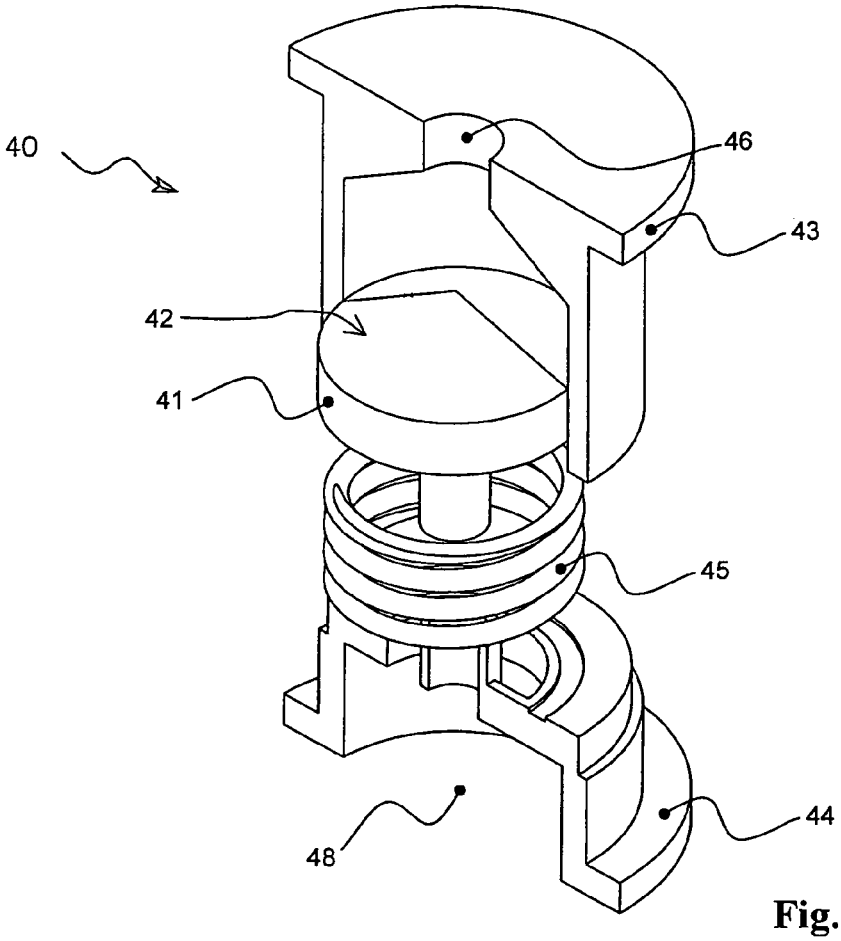
FIG. 7*b* is an exploded perspective view of this valve.

FIGS. 7*a* and 7*b* show the structure of such an output regulation valve 40.

It incorporates a plunger 41 incorporating a tapered end 42 intended to cooperate with a matching seat in a support 43. The support 43 is screwed to a base 44. A spring 45 is dimensioned solely to withstand the weight of the plunger 41. The latter thus presses on its seat in the valve's rest position (as shown in FIG. 7*a*).

The direction of passage of the cool gas is shown by arrows D.

The cool gas from the duct 22 enters into the valve 40 via the opening 46. It pushes the plunger 41 against the action of the spring 45. The cool gas passes through the chamber 47 and exits downstream by bore hole 48 to move towards the inlet channel 35 in question.

We can see that the section of the passage for the gas will vary according to the axial position of the plunger 41.

An increase in the hot gas pressure downstream will therefore push the plunger upwards and reduce the cool gas inlet pressure.

The valve thus enables the hot gas pressure to be regulated thereby regulating the air rate in the different manifolds. Depending on the energy loss characteristics of the manifolds 36 in question, the characteristics of the valve will naturally be different.

The different valves will be dimensioned according to the required result, which is to obtain the same hot gas output rate for all the manifolds at the evacuation duct 37.

Someone skilled in the art will easily dimension these different valves depending on the generator he is producing.

The hot gas generator according to the invention may be implemented in different facilities.

Figure 8:
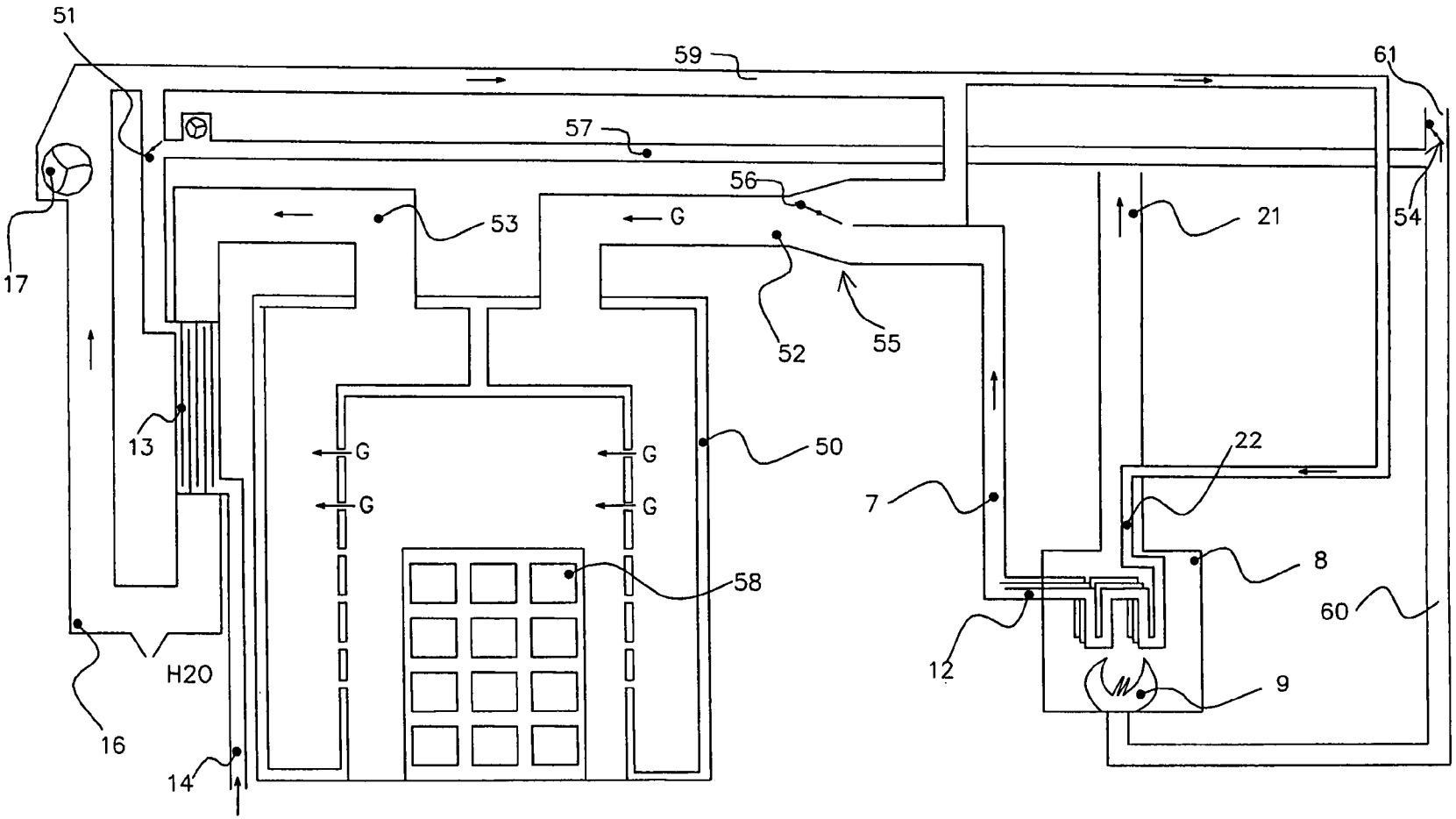
FIG. 8 shows a dehydration facility implementing the generator according to the invention.

FIG. 8 thus shows a dehydration facility, for example for timber.

This facility 1 comprises a closed enclosure 50 inside which the timber sections 58 to be dried are placed, for example on a log carriage.

The generator 8 supplies hot air by its gas evacuation piping 7 and receives cool air by its duct 22.

The piping 7 is linked to the enclosure 50 by a duct 52.

After circulating through the enclosure 50, the hot air is evacuated by an outlet duct 53 linked to a condenser 13.

This condenser is cooled by the exterior cool air circulating in an exchange circuit and entering this circuit by the inlet manifold 14.

The condenser 13 enables the dehydration of the hot air circulating in the duct 53.

The now dehydrated air is brought to the inlet duct 22 of the generator 8 via duct 59.

Liquid water ($H_2O$) is recovered at the bottom 16 of the condenser 13. An accelerator (such as a pump) 17 enables the hot air flow G circulating in the enclosure 50 and in the generator 8 to be accelerated and regulated.

Thus, the duct bringing cool air 22 to the generator 8 is linked to a circuit to recover the hot air extracted from the enclosure 50 receiving the matter to be dehydrated.

Part of the hot air recovered in the condenser 13 is used to activate the burner or heating appliance 9 by the duct 57. This duct is linked to the duct 22 by means of a three-way control valve 51 whose purpose is to enable the extraction of a quantity of preheated air to make up for any losses caused by leakage. Another three-way control valve 54 is positioned between an upstream part (duct 57), a downstream part 60 (towards the burner) and an exhaust 61. It enables the regulation of the preheated air flow required to activate the burner or heating appliance 9. Any final excess will be directed by the exhaust 61 to the exterior or to another application via control valve 54.

This closed circuit functioning ensures the preheating of the cool air thereby improving the efficiency of the facility.

Furthermore, a mixer 55 is positioned at the inlet to the enclosure 50. This mixer makes it possible to dose the hot air from the generator 8 with part of the cool air exiting the condenser 13 by means of a shutter 56.

The dehydration temperature can thus be regulated relatively precisely. A facility may thus be produced that operates continuously with an air temperature of 120° C. ensuring the rapid drying of the timber.

Naturally, it is possible for drying facilities to be produced for different types of matter, for example to dry cereals.

The invention claimed is:

1. A dehydration or drying facility comprising:

at least one hot gas generator for a dehydration or drying unit, the generator further comprising:

a burner or a heating appliance, at least one exchange circuit incorporating at least two manifolds in which gas circulates that is to be heated, each of said manifolds comprising:

one intake end for cool gas, one exhaust outlet end for the hot gas, a thermal exchange surface for combustive gases generated by said burner or heating appliance and the gas to be heated circulating in the manifold, and a physical separation between the gas to be heated and the combustive gases generated by said burner or heating appliance;

a recovery circuit incorporating at least one condenser that dehydrates the hot gas;

an enclosure that receives matter or materials to be dehydrated; and a mixer positioned upstream of said enclosure and enabling said hot gas from said generator to be mixed with cool gas from said condenser, wherein the intake end for cool gas is linked to the recovery circuit to recover said hot gas which is extracted from the enclosure.

2. The dehydration or drying facility according to claim 1, wherein said manifolds of said exchange circuits are oriented such that said gas to be heated circulates in said manifolds in a direction that is the opposite of that of flow of said combustive gases from said burner or heating appliance.

3. The dehydration or drying facility according to claim 1, wherein said generator incorporates regulating means enabling a flow rate of said hot gas exiting each of said manifolds to be regulated.

4. The dehydration or drying facility according to claim 1, wherein said exchange circuit incorporates an outlet collector channel and at least two inlet channels, said outlet channel and said inlet channels being connected to one another by one of said manifolds, resulting in multiple manifolds which are substantially parallel to one another.

5. The dehydration or drying facility according to claim 4, wherein said inlet channels and said outlet channel are substantially ring-shaped.

6. The dehydration or drying facility according to claim 4, wherein said generator incorporates at least one of said manifolds having an undulated profile.

7. The dehydration or drying facility according to claim 4, wherein said generator comprises an O-shaped duct to collect said hot gases, said duct being linked to said outlet collector by tubes.

8. The dehydration or drying facility according to claim 4, wherein said generator comprises an inlet duct for the cool gas connected to said inlet channels by tubes.

9. The dehydration or drying facility according to claim 8, comprising regulating means constituted by valves positioned between said inlet duct and each of said tubes.

10. The dehydration or drying facility according to claim 9, wherein said inlet channels are compartmented into different sectors, each sector being linked to a single valve.

11. The dehydration or drying facility according to claim 1, wherein said generator incorporates at least two exchange circuits and two chambers, each of said exchange circuits being positioned in one of said chambers through which said combustive gases circulate.

12. The dehydration or drying facility according to claim 11, wherein said two chambers are concentric, the passage of said combustive gases from one of said chambers to another being made at one end of the first chamber of said two chambers, the direction of circulation of said combustive gases in the second chamber of said two chambers being the opposite that in said first chamber.

13. The dehydration or drying facility according to claim claim 12, wherein said exchange circuit incorporates an outlet collector channel and at least two inlet channels said outlet channel an said inlet channels bein connected to one another by one of said manifolds, resulting in multiple manifolds which are substantially parallel to one another, said generator corn rises an inlet duct for the cool gas connected to said inlet channels by tubes, and said inlet duct is positioned coaxially to said first chamber inside a vent to evacuate said combustive gases.

14. The dehydration or drying facility according to claim 12, wherein said burner or heating appliance is positioned at a second end of said first chamber.

15. The dehydration or drying facility according to claim 12, wherein said generator incorporates a third chamber surrounding said second chamber, said third chamber enclosing said manifolds linking said exchange circuit to said cool gas inlet duct.

16. The dehydration or drying facility according to claim 12, wherein an inlet duct is positioned coaxially to said first chamber inside a vent to evacuate said combustive gases.

17. The dehydration or drying facility according to claim 12, wherein said burner or heating appliance is positioned at a second end of said first chamber.

18. The dehydration or drying facility according to claim 12, wherein said generator incorporates a third chamber surrounding said second chamber, said third chamber enclosing said manifolds linking said exchange circuit to said inlet duct.

19. The dehydration or drying facility according to claim 1, wherein said facility comprises a circuit to activate said burner or heating appliance, said circuit using part of said hot gas from said condenser.

* * * * *